US005671687A

United States Patent [19]

Chen

[11] Patent Number: 5,671,687

[45] Date of Patent: Sep. 30, 1997

[54] INCINERATOR HAVING A FULLY AUTOMATIC FEEDER

[76] Inventor: Chwan Yuh Chen, No. 65-2, Chinguang Road, Uryh Shiang, Taichung County, Taiwan

[21] Appl. No.: 491,445

[22] Filed: Jun. 16, 1995

[51] Int. Cl.[6] ..... F23B 5/00; F23H 7/10

[52] U.S. Cl. ..... 110/212; 110/215; 110/257; 110/248; 110/258; 110/278; 110/113; 110/171

[58] Field of Search ..... 110/215, 216, 110/248, 255, 257, 258, 259, 278, 281, 171, 113, 346

[56] References Cited

U.S. PATENT DOCUMENTS

| | | | |
|---|---|---|---|
| 3,208,411 | 9/1965 | Urban et al. | 110/215 X |
| 3,267,890 | 8/1966 | Zinn et al. | 110/215 X |
| 3,504,645 | 4/1970 | Davenport | 110/257 |
| 3,745,939 | 7/1973 | Allbritton | 110/216 X |
| 4,843,979 | 7/1989 | Phillips | 110/215 |

*Primary Examiner*—Henry A. Bennett
*Assistant Examiner*—Susanne C. Tinker
*Attorney, Agent, or Firm*—Pro-Techtor International

[57] ABSTRACT

An incinerator comprises a feeding plate, a first combustion chamber, a second combustion chamber, a curved duct, an air exhausting device, a water screen device, and a water tank. The feeding plate is provided on the underside thereof with a vibrating device for causing the feeding plate to vibrate so as to move trash gradually into the first combustion chamber in which trash is incinerated to produce ash and exhaust fume which is then burned completely in the second combustion chamber. When the exhaust fume is passed through the water screen located in the curved duct, ash contained in the exhaust fume is washed away and deposited in the water tank which is provided therein with a device for removing ash that is deposited in the water tank.

3 Claims, 2 Drawing Sheets

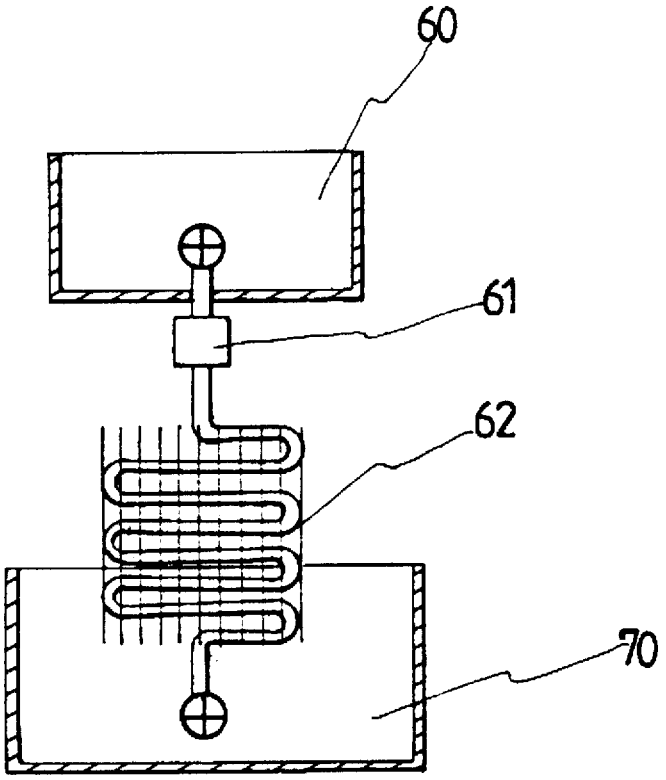
FIG, 2

INCINERATOR HAVING A FULLY AUTOMATIC FEEDER

FIELD OF THE INVENTION

The present invention relates generally to an incinerator, and more particularly to an incinerator having a fully automatic feeder for improving the efficiency of the process of incinerating trash.

BACKGROUND OF THE INVENTION

The best way to dispose of trash is to burn the trash with an incinerator. There are a variety of incinerators available for use in burning trash; nevertheleess they are deficient in one way or another. An improved incinerator disclosed in the Taiwanese Patent Serial Number 226191 is a case in point. The improved incinerator is capable of incinerating trash effectively without the problem of fume discharge. However, such an improved incinerator of the prior art as mentioned above is not cost-effective in view of the fact that it can not be used to incinerate a large amount of trash.

SUMMARY OF THE INVENTION

It is therefore the primary objective of the present invention to provide an incinerator comprising an incinerating body which is provided with an inclined feeding plate having on the underside thereof a vibrating device. The incinerating body is provided therein with a first combustion chamber opposite in location to the feeding plate and communicating with a curved duct which is connected with an air pump. The incinerating body is further provided therein with a second combustion chamber, and a water screen in communication with a water tank. The combustible trash is sent via the vibrating motion of the feeding plate into the first combustion chamber. The exhaust fume in the first combustion chamber is transferred to the second combustion chamber in which the exhaust fume is burned completely. When the exhaust fume is sent through the water screen, the particles in the exhaust fume are picked up and disposed of.

It is another objective of the present invention to provide an incinerator with a feeding plate having a vibrating device which is actuated by an electric actuating member. The actuating member is linked with an action rod which is fastened at both ends thereof with the bottom of the feeding plate. The action rod is provided with pulleys slidable on the rails located in the incinerator. The action rod is capable of causing the inclined feeding plate to vibrate so as to send the combustible trash downwards.

It is still another objective of the present invention to provide an incinerator with a water screen and a water tank having therein an electrically-actuated spiral blade for removing the ask collected in the water tank.

BRIEF DESCRIPTION OF THE DRAWINGS

FIG. 2 is a schematic view showing the connection between the water screen (from the point labeled "B" in FIG. 1) and the water tank (from the point labeled "A" in FIG. 1) of the present invention.

DETAILED DESCRIPTION OF THE INVENTION

Figure 1:
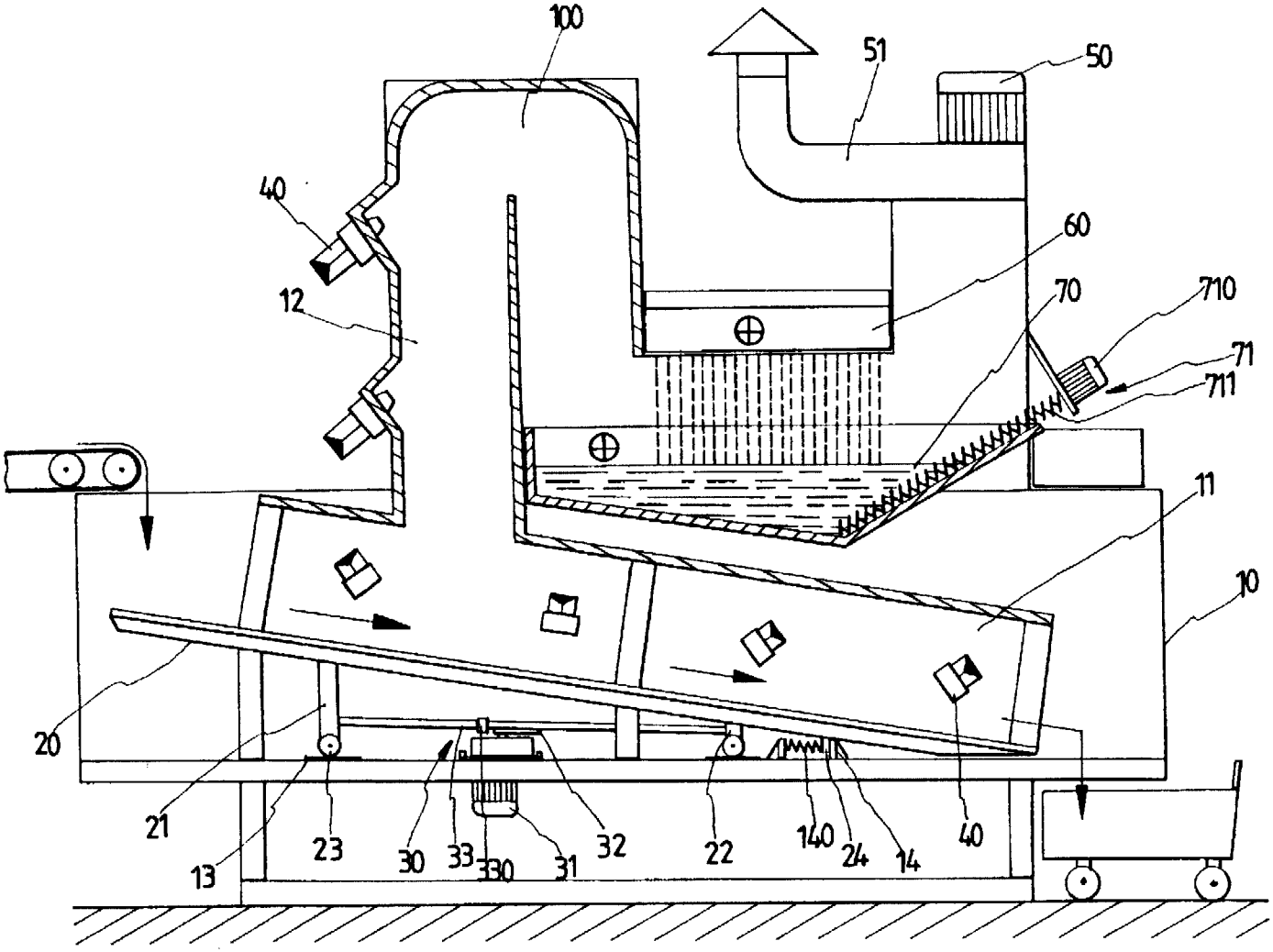
FIG. 1 shows a schematic view of the present invention.

As shown in FIG. I, an incinerator embodied in the present invention comprises an incinerating body 10 which is provided with an inclined feeding plate 20 having there-under a vibrating device 30, The feeding plate 20 is located at the bottom of a first combustion chamber 11 which is provided therein with a plurality of burning devices 40 capable of igniting at various angles, The incinerating body 10 is further provided in the upper portion thereof with a curved duct 100 in communication with the first combustion chamber 11. The exhaust fume in the first combustion chamber 11 can be discharged by an air exhausting pipe 51 via the curved duct 100. The exhausting pipe 51 is provided with an air pump 50. The incinerating body 10 is still further provided therein with a second combustion chamber 12 located between the first combustion chamber 11 and the curved duct 100. The second combustion chamber 12 is provided therein with a plurality of burning devices 40. The curved duct 100 is provided therein with a water screen device 60 located between the second combustion chamber 12 and the air pump 50 and is further provided therein with a water tank 70 opposite in location to the water screen device 60. The water tank 70 is provided therein with an ash removing device 71.

The vibrating device 30 comprises an eccentric rotary disk 32 which is actuated by a motor 31 and is linked with a push block 330 of an action rod 33, The action rod 33 is provided at both ends thereof with less 21 and 22, which are provided respectively at the bottom ends thereof with a pulley 23 slidable on a rail 13. The feeding plate 20 is provided on the underside thereof with a protruded body 24 capable of cooperating with a compression spring 140 mounted on a spring seat 14. When the motor 31 is started, the action rod 33 is actuated by the rotary disk 32 such that the protruded body 24 of the feeding plate 20 is caused to push against the compression spring 140, thereby causing the inclined feeding plate 20 to vibrate along the rail 13 so as to send the trash into the first combustion chamber 11.

As shown in FIG. 2, a water pump 61 and a heat exchanging device 62 are arranged between the water screen device 60 and the water tank 70, which is provided therein with an ash removing device 71 comprising a motor 710 and a spiral rod 711 for removing the ash deposited in the water tank 70.

In operation, the trash is first deposited on the feeding plate 20 and is then moved gradually down into the first combustion chamber 11 by the vibrating feeding plate 20. While the trash is moved through the first combustion chamber 11, the noncombustible trash is collected at the exit end of the feeding plate 20. In the meantime, the fume of the combustible trash is drawn into the curved duct 100 by the suction generated by the air pump 50. While the fume is drawn into the curved duct 100, the fume is burned completely in the second combustion chamber 12 which is located between the first combustion chamber 11 and the inlet of the curved duct 100. Before the smoke from the second combustion chamber 12 is let out via the air exhausting pipe 51, the smoke is filtered by a water screen formed by the water screen device 60. The exhaust air is therefore free from ash, which is washed away by the water screen and deposited in the water tank 70.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An incinerator comprising:

a first combustion chamber provided therein with a plurality of ignition devices and at a bottom side thereof with a feeding plate having a downward inclination toward an exit end of said feeding plate, said feeding plate provided on an underside thereof with a vibrating device for vibrating said feeding plate such that trash deposited on an inlet end of said feeding plate can be moved downward gradually along an inclined surface of said feeding plate into said first combustion chamber in which combustible trash is incinerated to produce ash and exhaust fumes;

a curved duct communicating with said first combustion chamber and having an inlet end and an outlet end which is provided with an air pump and an air exhausting pipe;

a second combustion chamber located between said first combustion chamber and said inlet end of said curved duct and provided therein with a plurality of ignition devices for burning completely said exhaust fumes produced in said first combustion chamber; a water screen device that forms a water screen located in a mid-segment of said curved duct for washing away ash contained in said exhaust fumes before said exhaust fumes from said second combustion chamber is exhausted via said air exhausting pipe; and a water tank for collecting said ash that is washed away form said exhaust fumes by said water screen, said water tank is provided therein with an ash removing means; wherein said vibrating device comprises an electrically-operated actuating means which is linked with an action rod, said action rod is provided at both ends thereof with a leg which is fastened at an upper end thereof to said action rod and at a lower end thereof to a pulley slidable on a rail located under said feeding plate, said feeding plate is provided on the underside thereof with a protruded body which causes said feeding plate to vibrate along said rail by pressing against a compression spring located under said feeding plate when said action rod is actuated by said actuating means of said vibrating device.

2. The incinerator as defined in claim 1, wherein:

said water screen device and said water tank are in communication by means of a water pump and a heat exchanging device such that water contained in said water tank is cleaned by means of an ash removing device and then is recycled to said water screen device.

3. The incinerator as defined in claim 1, wherein:

said exit end of said feeding plate is provided with a means of collecting noncombustible trash.

* * * * *